US006310600B1

(12) United States Patent
Koyama et al.

(10) Patent No.: US 6,310,600 B1
(45) Date of Patent: Oct. 30, 2001

(54) ACTIVE MATRIX TYPE DEVICE USING FORCIBLE REWRITING

(75) Inventors: Jun Koyama; Yasuhiko Takemura, both of Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/096,371

(22) Filed: Jun. 12, 1998

Related U.S. Application Data

(62) Division of application No. 08/392,475, filed on Feb. 22, 1995, now Pat. No. 5,767,832.

(30) Foreign Application Priority Data

Feb. 25, 1994 (JP) ..... 6-53052

(51) Int. Cl.[7] ..... G09G 3/36
(52) U.S. Cl. ..... 345/103
(58) Field of Search ..... 345/103, 100, 345/98, 96, 94, 87, 84; 348/751; 349/1, 33

(56) References Cited

U.S. PATENT DOCUMENTS 4,430,648 * 2/1984 Togashi et al. ..... 340/718
5,047,849 * 9/1991 Hara ..... 358/105
5,170,246 * 12/1992 Griffen ..... 358/17
5,457,474 * 10/1995 Ikeda ..... 345/103
5,506,601 4/1996 Mihara et al. ..... 345/100 X
5,534,884 7/1996 Mase et al. .
5,767,832 6/1998 Koyama et al. ..... 345/103
5,917,461 * 6/1999 Sakami et al. ..... 345/29
5,936,678 * 8/1999 Hirashima ..... 348/537

FOREIGN PATENT DOCUMENTS 03-085591 4/1991 (JP) .
04-120591 4/1992 (JP) .
04-301680 10/1992 (JP) .
05-323951 12/1993 (JP) .

* cited by examiner

*Primary Examiner*—Richard Hjerpe
*Assistant Examiner*—Ronald Laneau
(74) *Attorney, Agent, or Firm*—Eric J. Robinson; Nixon Peabody LLP

(57) ABSTRACT

Power consumption is reduced by decreasing the frequency of image rewriting to pixels in displaying images which have a portion of a screen that does not vary between frames. On the other hand, to cope with the phenomenon that image information (for instance, pixel voltages) deteriorates over time, a refresh operation is performed regularly. Interlaced scanning is performed skipping a plurality of rows. The refresh operation is performed over several frames in which part of the rows are refreshed in one frame. A flicker is thus prevented which occurs when the entire screen is refreshed in one frame.

27 Claims, 13 Drawing Sheets

ACTIVE MATRIX TYPE DEVICE USING FORCIBLE REWRITING

This application is a Divisional of Ser. No. 08/392,475, filed Feb. 22, 1995, now U.S. Pat. No. 5,767,832.

BACKGROUND OF THE INVENTION

The present invention relates to an active matrix type display device and a display method thereof. The active matrix type display device means a display device in which pixels are arranged at respective intersecting points of a matrix, every pixel is provided with a switching element, and image information is controlled by on/off switching of the switching elements. Examples of display media for the active matrix type display device are a liquid crystal, plasma and other bodies or states whose optical characteristic (reflectance, refractive index, transmittance, light emission intensity, or the like) can be changed electrically. The invention particularly relates to an active matrix type display device which uses, as the switching element, a three-terminal element, i.e., a field-effect transistor having the gate, source and drain.

In describing the invention, the term "row" of a matrix means a structure in which a signal line (gate line) that is disposed parallel with a row concerned is connected to the gate electrodes of transistors belonging to the row. The term "column" means a structure in which a signal line (source line) disposed parallel with a column concerned is connected to the sources (or drains) of transistors belonging to the column. A circuit for driving the gate lines and a circuit for driving the source lines are called a gate driver and a source driver, respectively.

Flat panel displays (FPDs) have been developed as new display devices to replace a CRT display. The active matrix type display device is typical of those flat panel displays. In the active matrix type display device, a screen is divided into pixels and the individual pixels are provided with respective switching elements, which control display information that is retained by the pixels. A typical example of the active matrix type display device is a thin-film transistor (TFT) active matrix display using a TN (twisted nematic) liquid crystal.

In this display device, the display medium is the TN liquid crystal and the image information is voltages of the pixels. That is, the transmittance of the TN liquid crystal (display medium) is controlled by a voltage retained by each pixel. Conventionally, in this type of active matrix type display device, an image is rewritten by updating display contents of all the pixels by top-to-bottom sequential scanning of rows. The image rewriting is performed at a frequency of every frame, i.e., 30 to 60 times per second (30–60 Hz).

However, for certain types of display contents, the image rewriting of such a frequency is not always necessary. For example, a still image need not be rewritten until voltages retained by the pixels decrease to such low values as cannot provide sufficient display quality. Even in the case of moving images, not all the pixels display different image information every time.

The image rewriting requires output of signals, which is a factor of increasing power consumption and, therefore, an obstacle to portable applications.

SUMMARY OF THE INVENTION

The present invention has been made in view of the above circumstances, and has an object of reducing power consumption by making the frequency of image rewriting as low as possible in an active matrix type electro-optical device.

To attain the above object, the invention is characterized by the following steps.

First, a signal to be applied to the pixels of a certain row is compared with a corresponding signal of the immediately previous frame. A signal (refresh pulse) indicating the necessity of rewriting is output only when the two signals are different for at least one pixel of the row concerned. The difference between the two signals (which are, for example, and input signal and an output signal of a delay circuit) is detected by comparing the two signals in the delay circuit.

The rewriting is then effected by applying a gate pulse to a gate line of the row concerned by using the refresh pulse, to thereby make the gate electrodes of active matrix transistors of the row concerned in an on state.

If a signal to be applied to the pixels of the row concerned is the same as a corresponding signal of the immediately previous frame for all the pixels, no refresh pulse is issued as a general rule. However, if a state in which image information is kept completely the same continues over a very large number of frames, no execution of rewriting for such a long time causes various problems. For example, where a TN liquid crystal is used as the display medium, application of a voltage of the same polarity for a long time causes an electrolysis, resulting in its deterioration. Therefore, polarity inversion needs to be performed regularly. Where only a single transistor is used as the active matrix switching element, image information (for instance, a voltage) stored in a pixel is varied by a source-drain leak current etc.

Considering the above, in the invention, rewriting to pixels is forcibly effected one per several frames even if no change occurs in image information. Where a liquid crystal material is used as the display medium, it is favorable that the polarity of voltages applied to the liquid crystal be inverted (applying AC voltages) in the process of forcibly effecting the rewriting to pixels.

In the above manner, power consumption can be reduced by decreasing the frequency of image rewriting as a whole by effecting the rewriting to only pixels or rows which need the rewriting. To avoid deterioration of display characteristics, it is effective that the regular rewriting be effected in the following manner.

Assume a matrix that is composed of 20 rows, i.e., a 1st row, 2nd row, 3rd, . . . , 19th row and 20th row. It is also assumed that completely the same image continues to be displayed by this matrix, and that forcible rewriting is performed once per 5 frames.

The simplest scheme is to perform rewriting to all the rows in the first frame and perform no rewriting in the second to fifth frames. However, in this scheme, the brightness varies during the second to fifth frames by such phenomena as reduction of pixel voltages. The same brightness as in the first frame is restored by rewriting in the sixth frame.

If the one-frame period is 30 msec, the interval between two rewriting operations is 150 msec. Therefore, a brightness variation due to the rewriting in the sixth frame is sufficiently recognizable, as a flicker, to the naked eye.

This problem can be solved by distributing rewriting operations to the first and fifth frames rather than effecting the rewriting only in the first frame. More specifically, four rows are subjected to rewriting in one frame. For example, in the first frame, rewriting is forcibly performed on only the 1st row, 6th row, 11th row and 16th row. In the second frame, rewriting is performed on the 2nd row, 7th row, 12th row and 17th row. In the third frame, rewriting is performed on the 3rd row, 8th row, 13th row and 18th row. In the fourth frame, rewriting is performed on the 4th row, 9th row, 14th row and 19th row. In the fifth frame, rewriting is performed on the 5th row, 10th row, 15th row and 20th row. The similar operations are performed in the sixth frame onward. Rewriting operations may be allocated in a different manner according to the same principle.

Stated more generally, where the entire matrix is divided into N groups each consisting of m rows, N rows are subjected to forcible rewriting in one frame and rewriting to the entire rows is completed in m frames.

In this case, for example, the above-mentioned 1st row may be referred to as a first group, first row; the above-mentioned 7th row as a second group, second row; the above-mentioned 14th row as a third group, fourth row; and the above-mentioned 20th row as a fourth group, fifth row. On the other hand, the groups and rows may be given numbers in different manners.

It is possible to make a flicker not recognizable by distributing forcible rewriting operations in the above manner. As a typical example, there is a rule that in the (k−1)th frame counted from a frame next to the frame (called the first frame) in which the first row of each group is subjected to forcible rewriting, i.e., in the kth frame (k=1, 2, 3, . . . , m), the kth row should be subjected to forcible rewriting. The above-described example satisfies this rule.

However, it is not required at all to satisfy such regularity. It is sufficient to satisfy a rule that in m consecutive frames, forcible rewriting should be performed in one frame on one row of a gate line group consisting of m arbitrary rows, and all the rows of that group should be subjected to rewriting.

If the invention is viewed in a different way, it is understood that it is sufficient to satisfy a rule that in the mth frame counted from a frame next to the frame (called the first frame) in which a certain row is subjected to forcible rewriting, i.e., in the (m+1)th frame, the same row should again be subjected to forcible rewriting.

Further, where a liquid crystal material is used as the display medium, it is favorable that the polarity of voltages applied to the pixels of a row concerned in the (m+1)th frame be opposite to the polarity of voltages applied to the same pixels in the first frame and the (2m+1)th frame. This is because utilizing such forcible rewriting the liquid crystal material can be supplied with indispensable AC voltages.

DESCRIPTION OF THE PREFERRED EMBODIMENTS

First Embodiment

Figure 1:
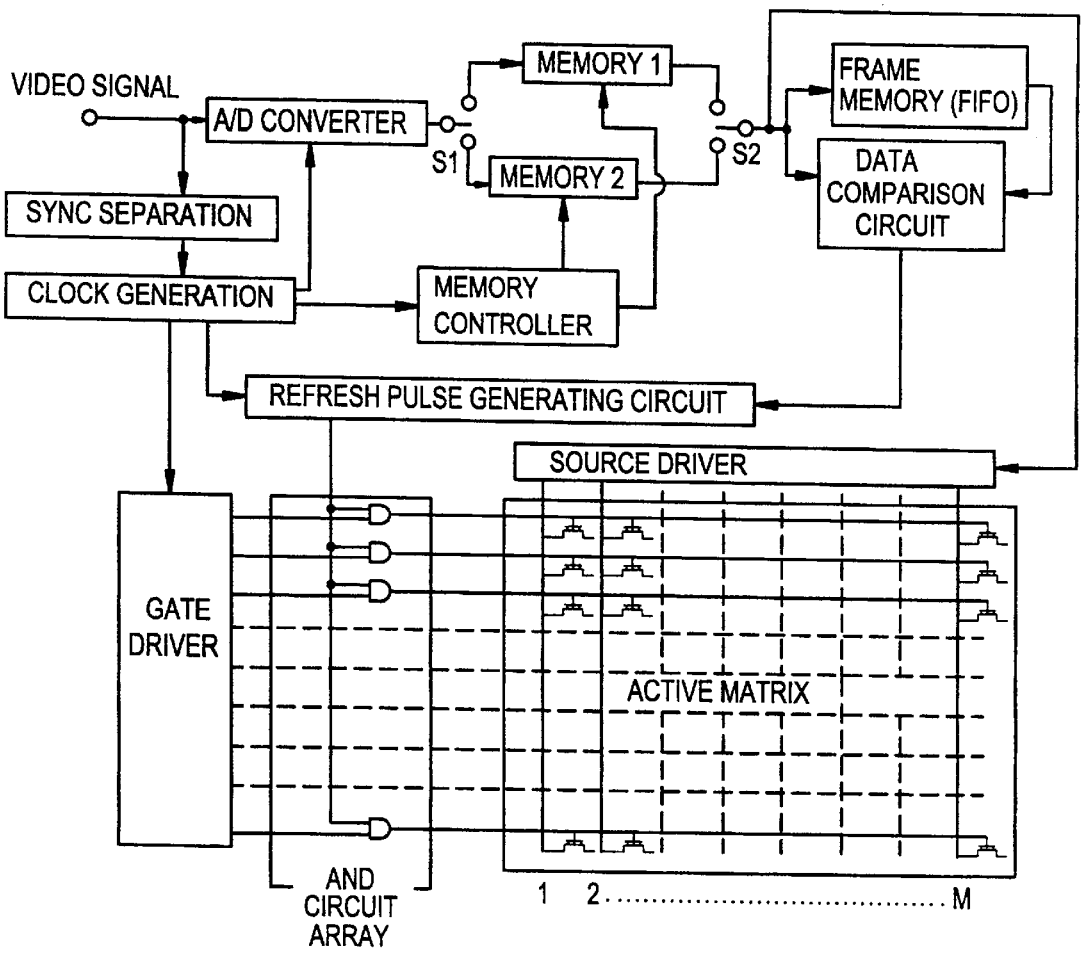
FIG. 1 is a block diagram showing a circuit configuration of a first embodiment.

A first embodiment of the invention will be described with reference to FIGS. 1–10. FIG. 1 shows a circuit configuration of this embodiment. An active matrix employs field-effect transistors (for instance, thin-film transistors) as the switching elements, and has a size of N×m rows and M columns. The rows are divided into N groups each including m gate lines. An ith group, jth row gate line is written as (i. j).

An analog video signal is converted by an A/D converter to a digital signal, which is sent to a memory. On the other hand, a sync signal is separated from the video signal by a sync separation circuit, and supplied to a clock generator.

Two memories, i.e., memory 1 and memory 2 are provided. (Alternatively, three or more memories may be provided.) A switch S1 sends data to memory 1 or memory 2. The data stored into the memory is immediately read out via a switch S2. That is, the switch S2 operates to read out the data from one of memory 1 and memory 2 which is not selected by the switch S1.

The reason why two or more memories are used to perform write and read operations is that the data sequence needs to be converted. In an ordinary video signal, data are arranged in the following order:

(1. 1), (1. 2), (1. 3), (1. 4), . . . , (1. m)
(2. 1), (2. 2), (2. 3), (2. 4), . . . , (2. m)
(3. 1), (3. 2), (3. 3), (3. 4), . . . , (3. m)
(4. 1), (4. 2), (4. 3), (4. 4), . . . , (4. m)
(N. 1), (N. 2), (N. 3), (N. 4), . . . , (N. m)

In this embodiment, the scanning order needs to be changed to the following by a method described later:

(1. 1), (2. 1), (3. 1), (4. 1), . . . , (N. 1)
(1. 2), (2. 2), (3. 2), (4. 2), . . . , (N. 2)
(1. 3), (2. 3), (3. 3), (4. 3), . . . , (N. 3)
(1. 4), (2. 4), (3. 4), (4. 4), . . . , (N. 4)
(1. m), (2. m), (3. m), (4. m), . . . , (N. m)

The signal obtained by the above data order change is sent to a frame memory and a data comparison circuit. The same signal is also supplied to a source driver. If the source driver is of a digital type, the signal can be input thereto as it is. However, if the source driver is of a analog type, the signal needs to be subjected to D/A conversion before being input thereto.

Figure 2:
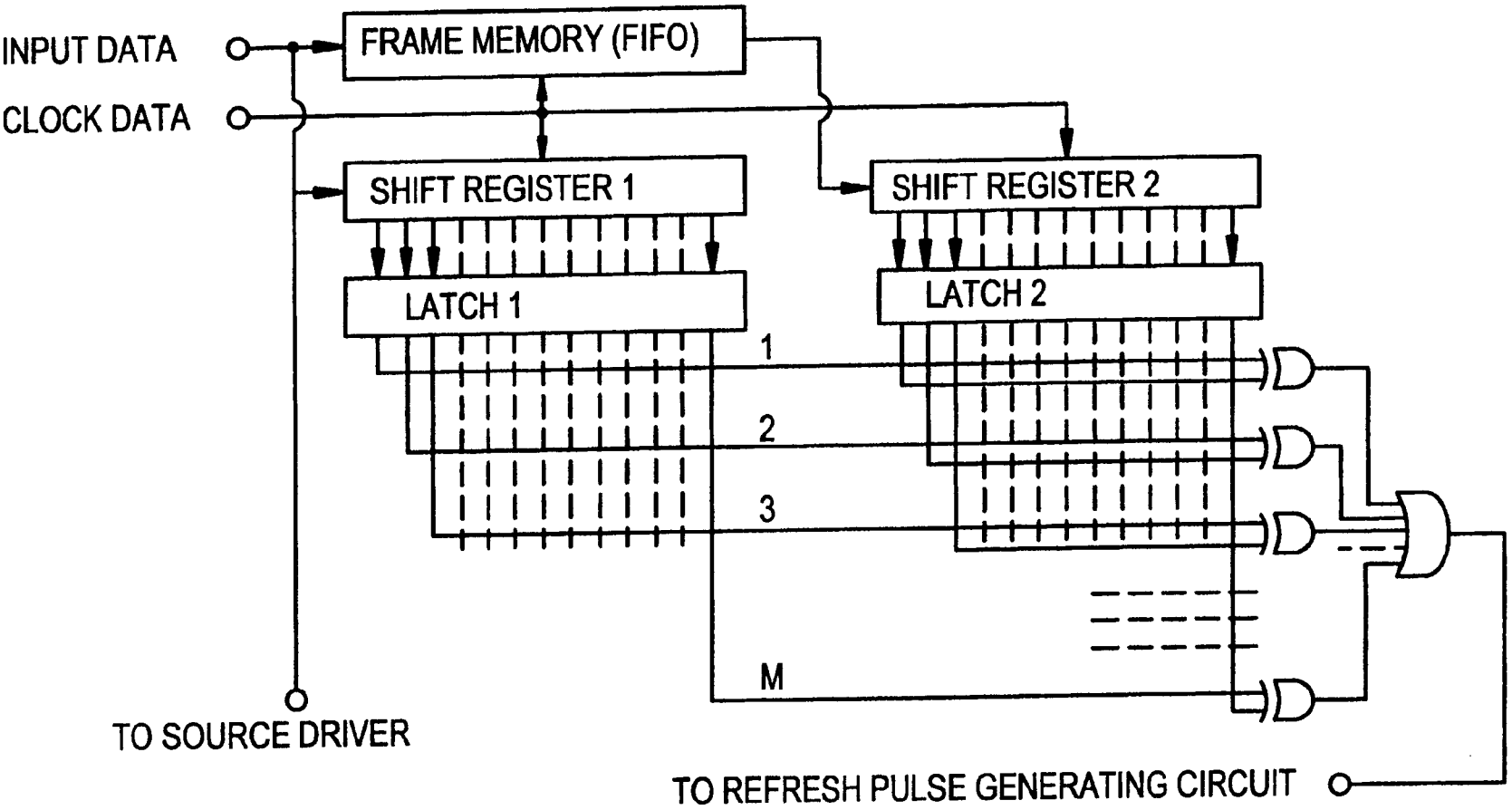
FIG. 2 shows a data comparison circuit in the first embodiment.

FIG. 2 shows details of the data comparison circuit. The frame memory stores one-frame previous data. A shift register 1 sends data of a row concerned of the current frame to latch 1. A shift register 2 sends data of the row concerned of the immediately previous frame to latch 2.

Assume that the gate driver currently applies a voltage to, for instance, the ith group, jth row. In this case, current data of the ith group, jth row is stored in latch 1 and data of the same row of the one-frame previous frame is stored in latch 2. One row includes M pixels, and two data of each pixel are compared with each other by one of M EXOR circuits shown on the bottom side of FIG. 2. If the current data and the one-frame previous data are different from each other, the EXOR circuit supplies an output to an OR circuit provided downstream thereof. That is, if the current data and the one-frame previous data are different from each other for at least one of the M pixels, the OR circuit supplies a signal to the refresh pulse generating circuit.

As soon as the comparison of the itch group, jth row is finished, a comparison of the (i+1)th group, jth row is started. In this manner, the data comparison is performed one after another.

The output of the data comparison circuit is sent, via the refresh pulse generating circuit, to an AND circuit array, which is provided between the gate driver and the active matrix. The existence of an output from the data comparison circuit means that the current information of the row concerned is different than the one-frame previous information. Therefore, a gate pulse needs to be generated to perform rewriting on the row concerned. As is apparent from FIG. 3, the OR circuit immediately supplies a refresh pulse to the AND circuit array upon reception of the data comparison signal. In response, an AND circuit of the row (ith group, jth row) that has received the output of the gate driver operates to output a gate pulse.

Figure 3:
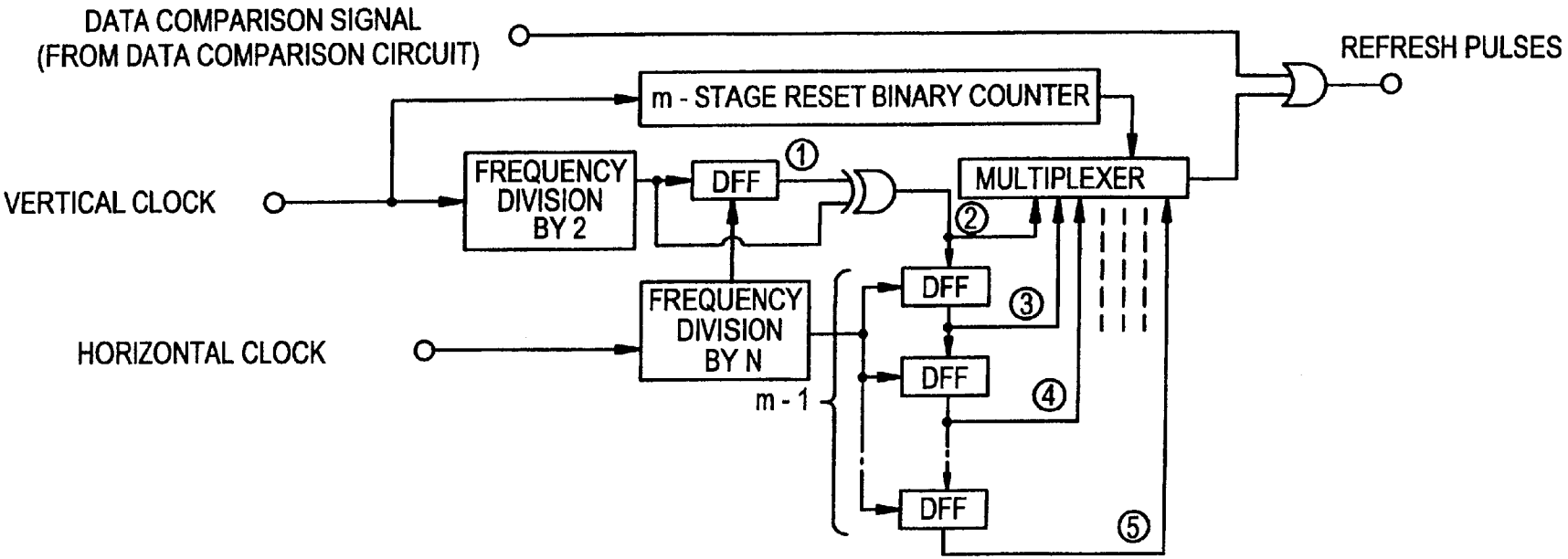
FIG. 3 shows a refresh pulse generating circuit in the first embodiment.
Figure 4:
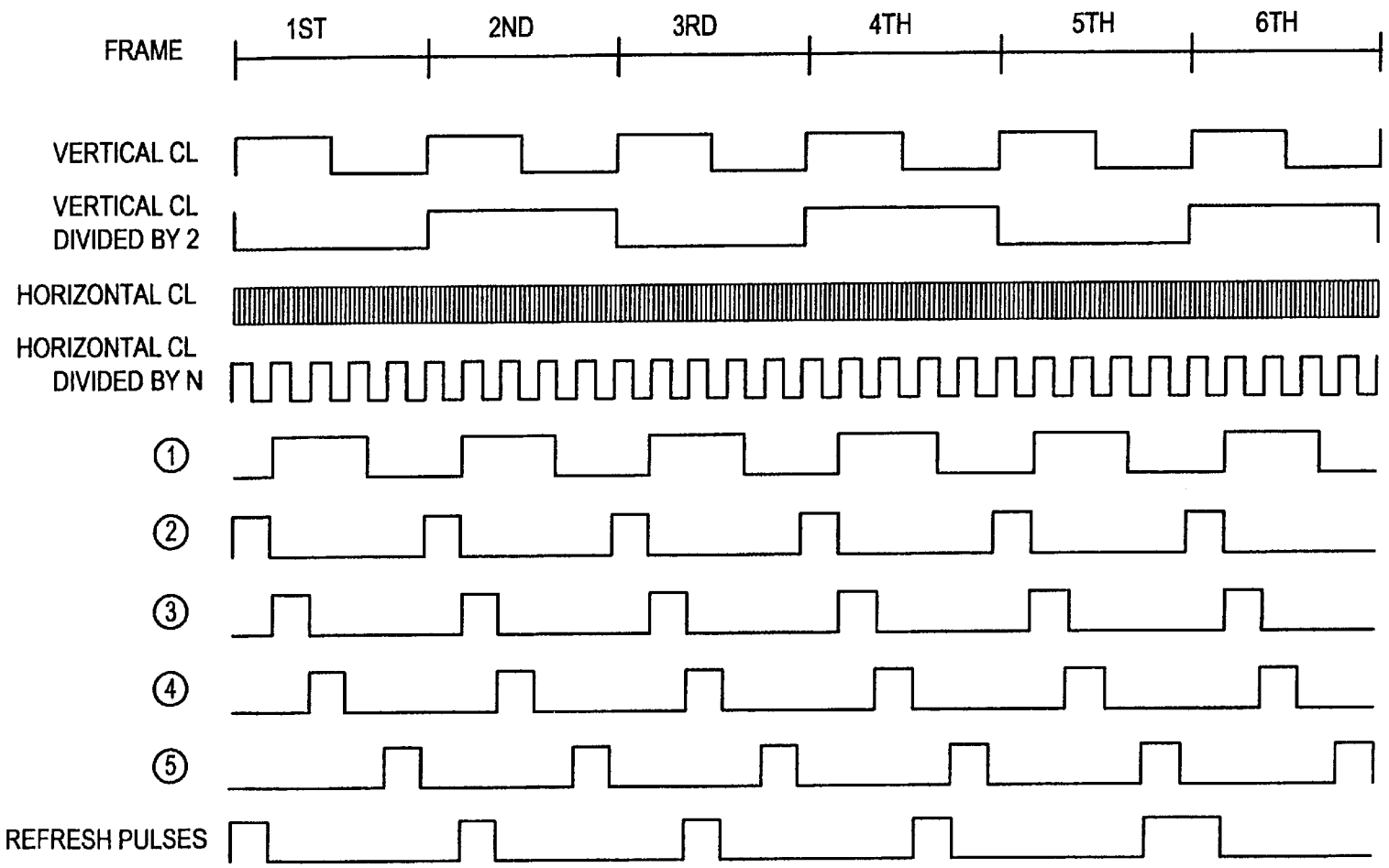
FIG. 4 is a time chart showing how refresh pulses are generated by the circuit of FIG. 3.
Figure 5:
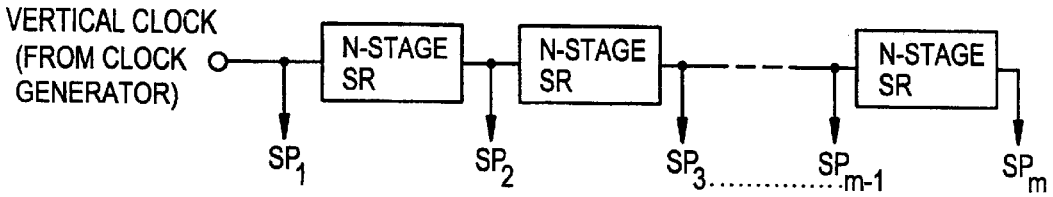
FIG. 5 shows a start pulse generating circuit of a gate driver in the first embodiment.
Figure 6:
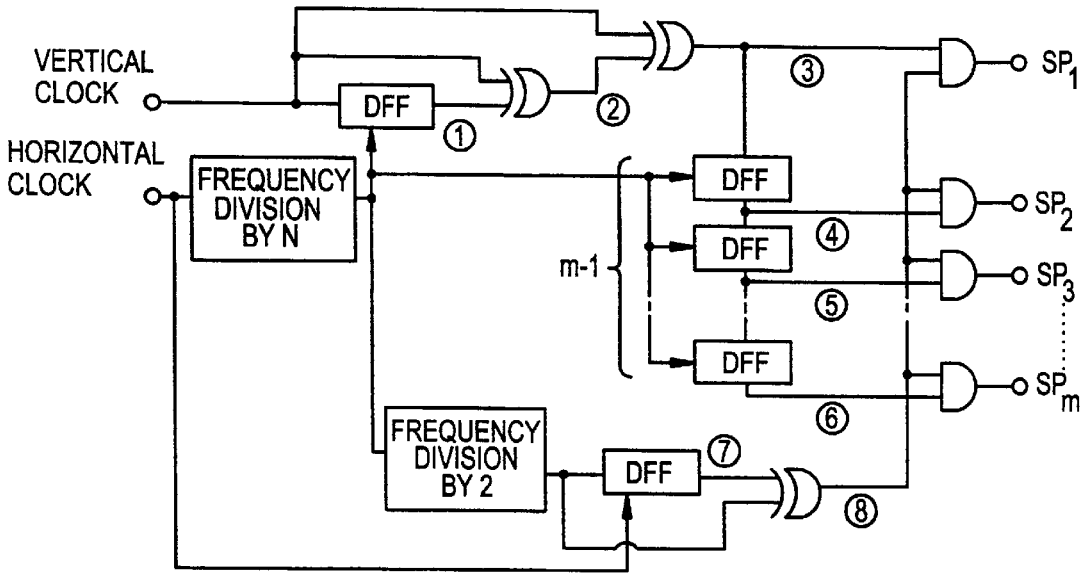
FIG. 6 shows another start pulse generating circuit of the gate driver in the first embodiment.
Figure 7:
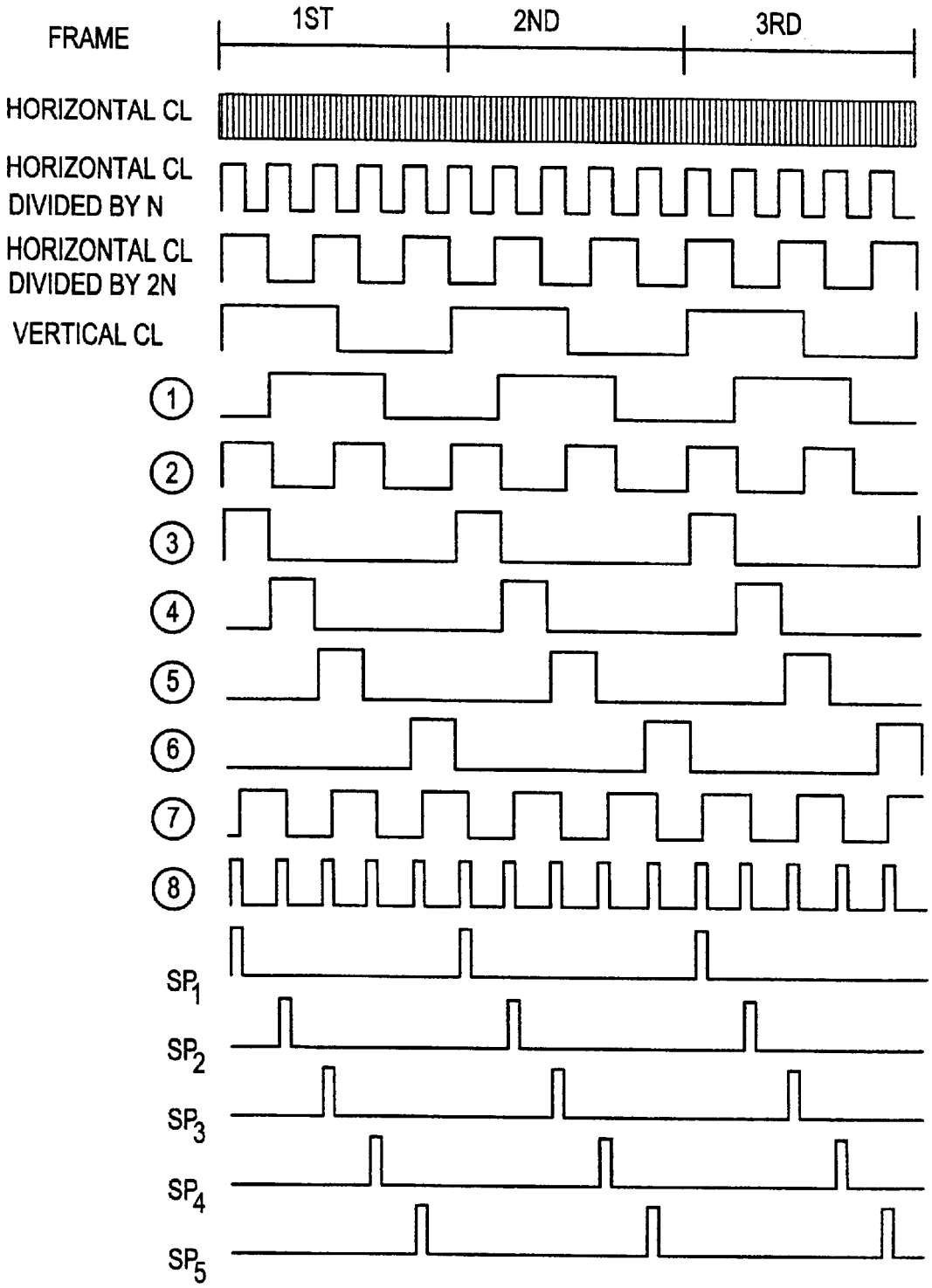
FIG. 7 is a time chart showing how start pulses are generated by the circuit of FIG. 5 or 6.

If the data comparison circuit generates no output, a signal to cause regular, forcible rewriting should be supplied to the AND circuit array. The circuit of FIG. 3 is adapted to perform such an operation. For simplicity, assume a 20-row matrix of N=4 and m=5. FIG. 4 is a time chart showing signals at points ①–⑤ in FIG. 3 and a refresh pulse output. In FIG. 4, a horizontal clock includes 20 pulses in a one-frame period. By dividing the frequency of the horizontal clock signal by N (=4), the number of pulses in the one-frame period can be reduced to 5.

Receiving the pulses thus generated, delay circuits (DFFs) operate to finally generate refresh pulses, which sequentially delay by a time equal to the one-frame period, to thereby return to the original timing in a 5-frame period. In FIG. 4, refresh pulses of the 5th and 6th frames are connected to each other. If no signal is output from the data comparison circuit (that is, if there is no change in the image information), only the refresh pulses shown in FIG. 4 are output.

Figure 8:
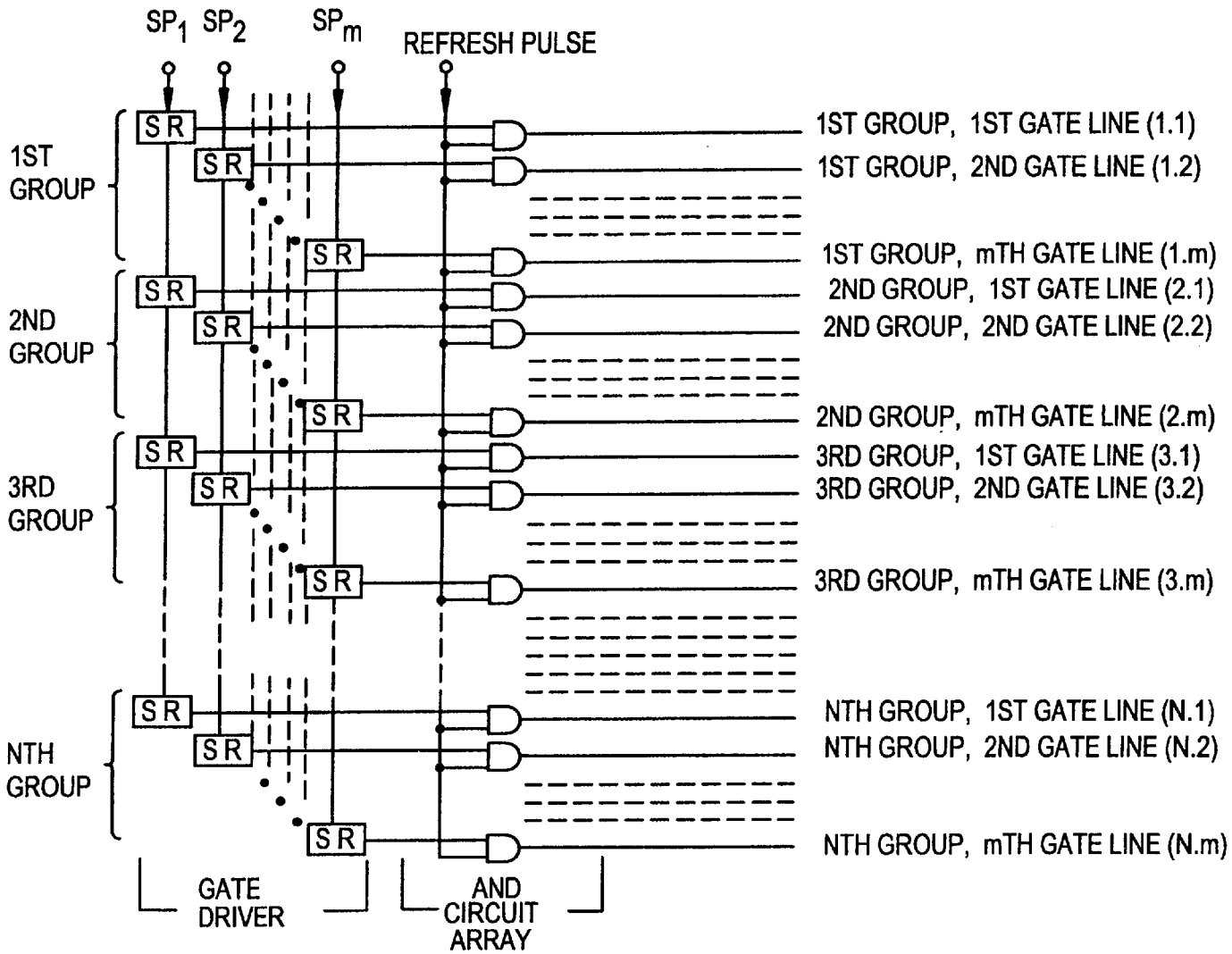
FIG. 8 shows the gate driver and its peripheral circuits in the first embodiment.

Now, a description will be made of the gate driver. As described above, the invention employs the scanning order that is different from the ordinary order. Therefore, the gate driver has a special configuration. FIG. 8 shows an example of the gate driver. That is, in this embodiment, m N-stage shift registers are provided in parallel. Start pulses $SP_1$–$SP_m$ for the respective shift registers are synthesized by a circuit shown in FIG. 5 or 6.

Figure 9:
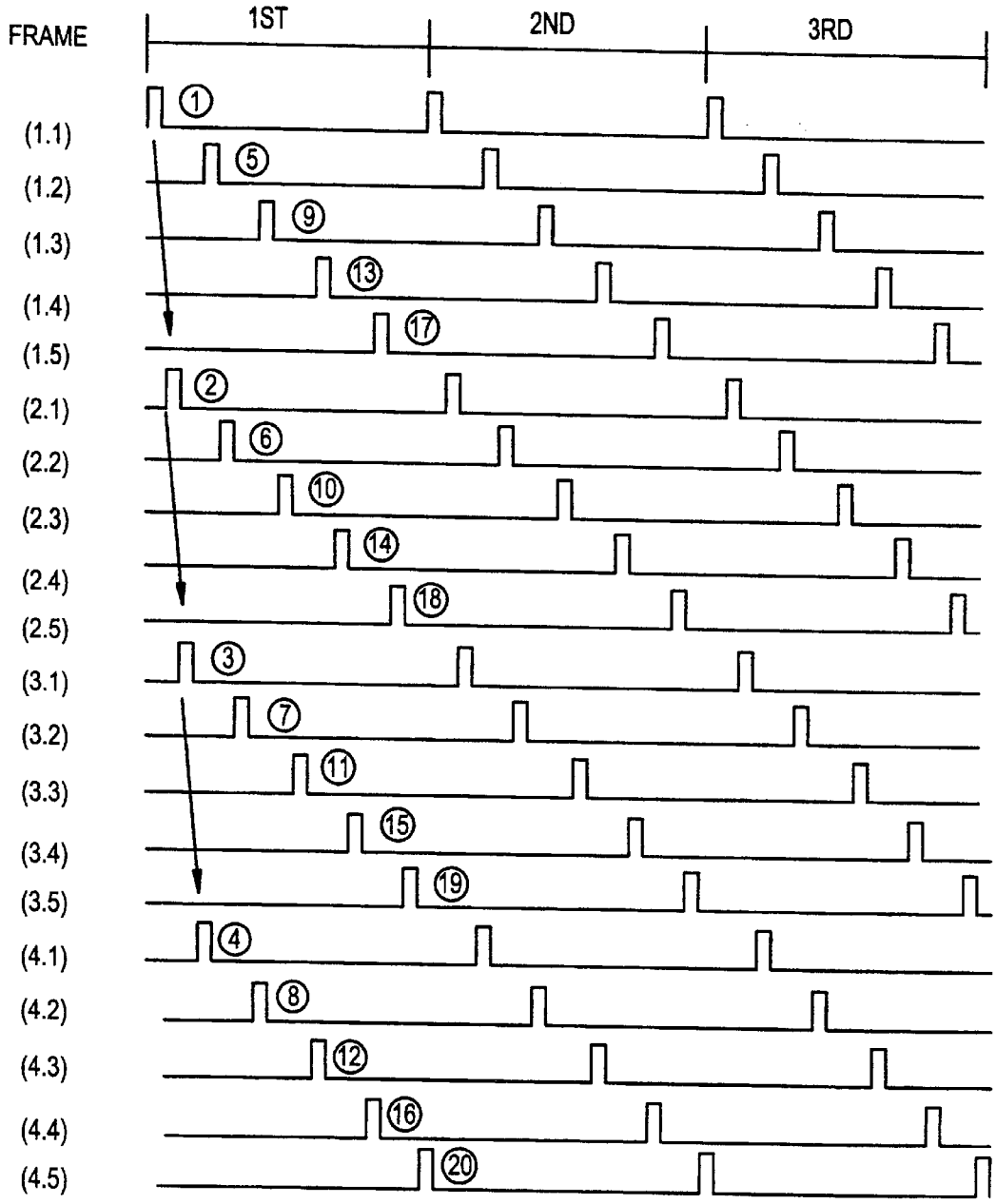
FIG. 9 shows outputs of the gate drivers in the first embodiment.

FIG. 9 is a time chart showing pulses at points immediately before the AND circuit array which pulses are generated by the above circuits and output from the gate driver of the matrix of N=4 and m=5. Circled numerals in FIG. 9 indicate the output order of the pulses. That is, the pulses are output, in order, to the first group, first row, the second group, first row, the third group, first row, the fourth group, first row, the first group, second row, the second group, second row, . . .

Figure 10:
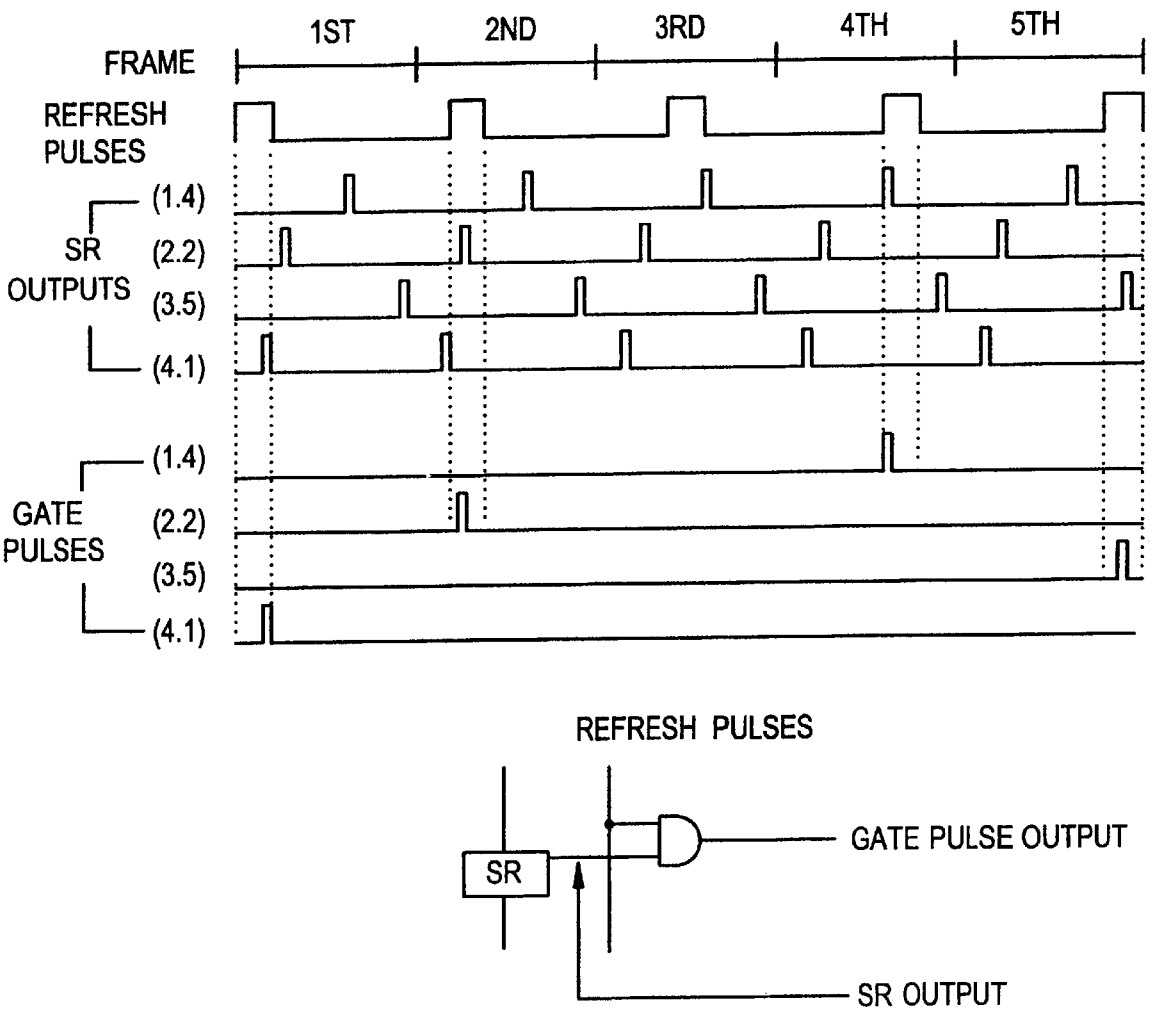
FIG. 10 is a time chart showing how gate pulses are output.
Figure 11:
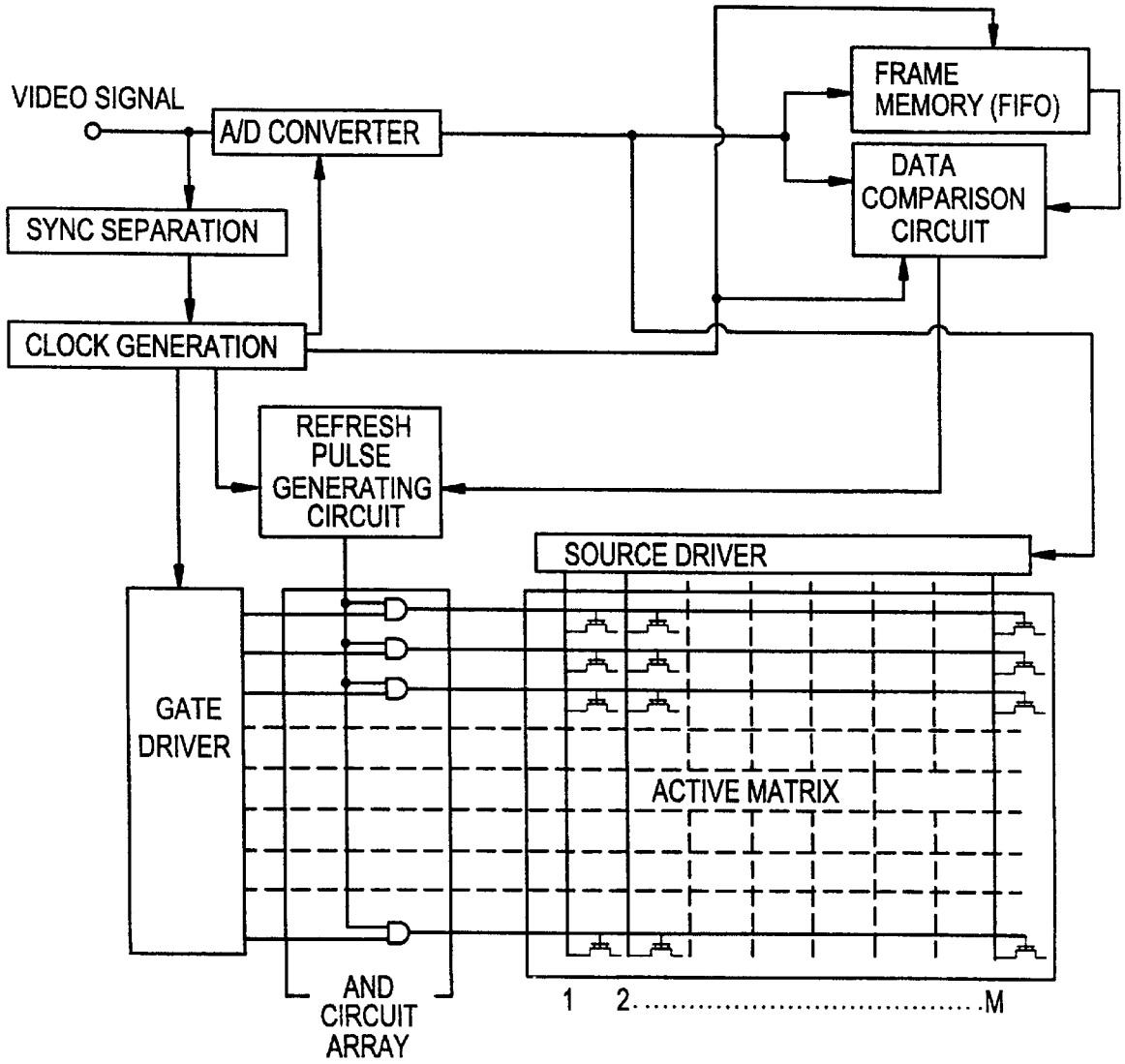
FIG. 11 is a block diagram showing a circuit configuration of a second embodiment.

The output pulses (SR outputs) of the gate driver which pulses have been synthesized in the above manner are combined with a refresh pulse in the AND circuit array in a manner shown in FIG. 10. For simplicity, it is assumed that the discussion is directed to a still image and there is no output from the data comparison circuit. Although FIG. 10 shows pulses for only the first group, fourth row (1. 4), the second group, second row (2. 2), the third group, fifth row (3. 5), and the fourth group, first row (4. 1), the same thing applies to the other rows. The shift registers (SRs) for the respective rows regularly output pulses in the first to fifth frames. Only when a refresh pulse coexists with one of the output pulses of the shift registers, it is supplied, as a gate pulse, to the matrix.

For example, in the case of the row (1. 4), the refresh pulse does not coexist with the SR output in any of the first to third frames and the fifth frame and, therefore, the AND circuit does not produce a gate pulse. A gate pulse is produced only in the fourth frame in which the refresh pulse coexists with the SR output. Similarly, a gate pulse is supplied to the row (2. 2) only in the second frame, to the row (3. 5) only in the fifth frame, and to the row (4. 1) only in the first frame.

That is, in this embodiment, a gate pulse is supplied to the ith group, jth row only in the jth frame.

It goes without saying that when there exists an output from the data comparison circuit, a refresh pulse is generated each time and a gate pulse is supplied to the corresponding row.

Second Embodiment

A second embodiment of the invention will be described with reference to FIGS. 11–14. FIG. 10 shows a circuit configuration of this embodiment. An active matrix employs field-effect transistors (for instance, thin-film transistors) as the switching elements, and has a size of N×m rows and M columns. The rows are divided into N groups each including m gate lines. An ith group, jth row gate line is written as (i. j).

An analog video signal is converted by an A/D converter to a digital signal, which is sent to a data comparison circuit. On the other hand, a sync signal is separated from the video signal by a sync separation circuit, and supplied to a clock generator.

In contrast to the first embodiment, the second embodiment employs the scanning order that is the same as the order in the ordinary display scheme. Therefore, the change of the data order as performed in the first embodiment is not necessary. That is, in this embodiment, the scanning is performed in the following order:

(1. 1), (1. 2), (1. 3), (1. 4), . . . , (1. m)
(2. 1), (2. 2), (2. 3), (2. 4), . . . , (2. m)
(3. 1), (3. 2), (3. 3), (3. 4), . . . , (3. m)
(4. 1), (4. 2), (4. 3), (4. 4), . . . , (4. m)
(N. 1), (N. 2), (N. 3), (N. 4), . . . , (N. m)

The frame memory and the data comparison circuit of this embodiment are the same as those of the first embodiment (see FIG. 2). The current frame data of a row concerned is compared with the one-frame previous data stored in the frame memory. If they are different from each other, a signal is sent from the data comparison circuit to a refresh pulse generating circuit provided downstream thereof.

Figure 12:
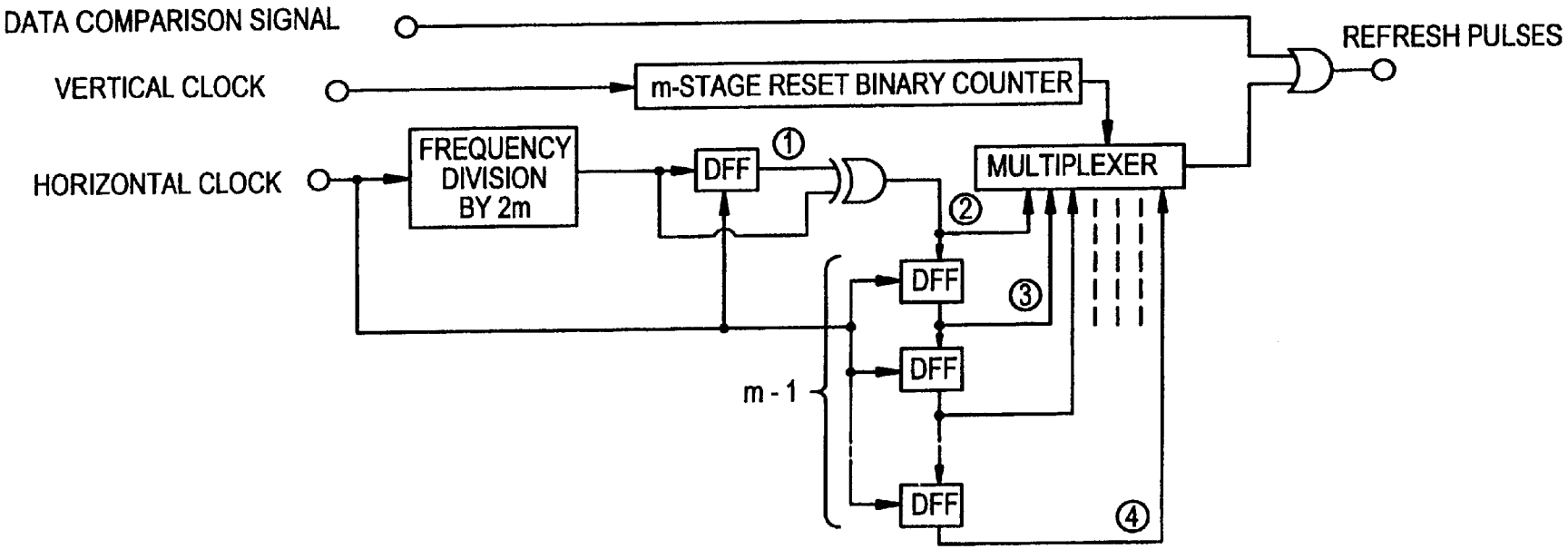
FIG. 12 shows a refresh pulse generating circuit in the second embodiment.

The output of the data comparison circuit is sent, via the refresh pulse generating circuit having a configuration shown in FIG. 12, to an AND circuit array, which is provided between the gate driver and the active matrix. The existence of an output from the data comparison circuit means that the current information of the row concerned (for example, ith group, jth row) is different from the one-frame previous information. Therefore, a gate pulse needs to be generated to perform rewriting on the row concerned. As is apparent from FIG. 12, the OR circuit immediately supplies a refresh pulse to the AND circuit array upon reception of the data comparison signal. In response, an AND circuit of the row (ith group, jth row) that has received the output of the gate driver operates to output a gate pulse.

Figure 13:
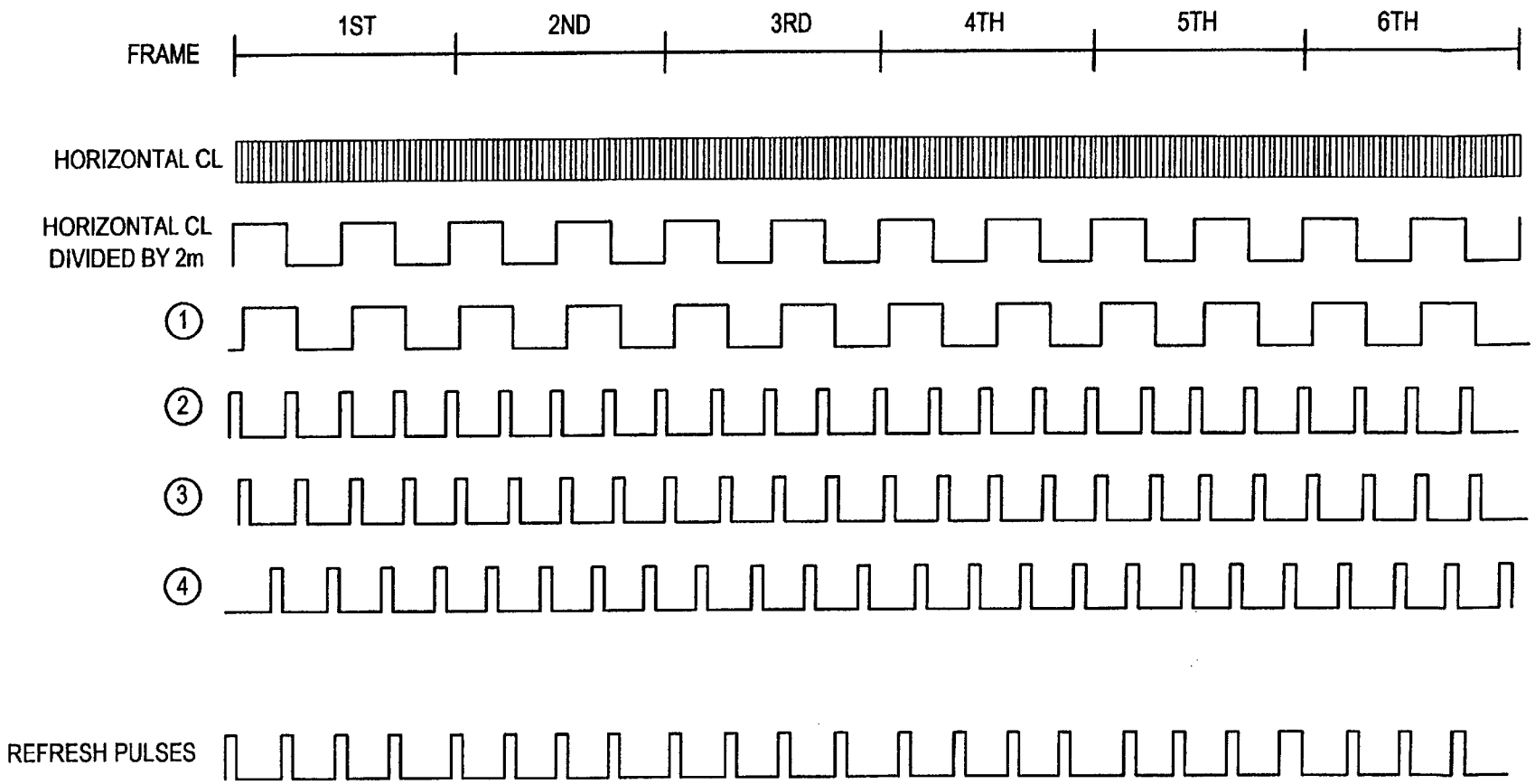
FIG. 13 is a time chart showing how refresh pulses are generated by the circuit of FIG. 12.

If the data comparison circuit generates no output, a signal to cause regular, forcible rewriting should be supplied to the AND circuit array. The circuit of FIG. 12 is adapted to perform such an operation. For simplicity, assume a 20-row matrix of N=4 and m=5. FIG. 13 is a time chart showing signals at points ①–④ in FIG. 12 and a refresh pulse output. In FIG. 13, a horizontal clock includes 20 pulses in a one-frame period. By dividing the frequency of the horizontal clock signal by 2m (=10), the number of pulses in the one-frame period can be reduced to 2.

Receiving the pulses thus generated, delay circuits (DFFs) operate to finally generate refresh pulses. Four refresh pulses are output in the one-frame period, and the intervals between those pulses are the same in a single frame. In a transition from the first frame to the second frame, the first pulse is delayed by a one-pulse period. Similarly, the first pulse delays by a one-pulse period in each transition from the second frame to the third frame, the third frame to the fourth frame, and the fourth frame to the fifth frame.

When a one-cycle operation of the first frame to the fifth frame is completed, a new cycle starts from the sixth frame. As is apparent from FIG. 13, in a transition from the fifth frame to the sixth frame, the last pulse of the fifth frame is connected to the first pulse of the sixth frame. The refresh pulses are synthesized in the above manner, and supplied to the AND circuit array. If no signal is output from the data comparison circuit (that is, if there is no change in the image information), only the refresh pulses shown in FIG. 13 are output.

The gate driver of this embodiment is the same as that in the first embodiment, and is composed of a single shift register of m×N stages. Outputs of the respective stages of the shift register are supplied to the AND circuit array in the following order:

(1. 1), (1. 2), (1. 3), (1. 4), . . . , (1. m)

(2. 1), (2. 2), (2. 3), (2. 4), . . . , (2. m)

(3. 1), (3. 2), (3. 3), (3. 4), . . . , (3. m)

(4. 1), (4. 2), (4. 3), (4. 4), . . . , (4. m)

(N. 1), (N. 2), (N. 3), (N. 4), . . . , (N. m)

Figure 14:
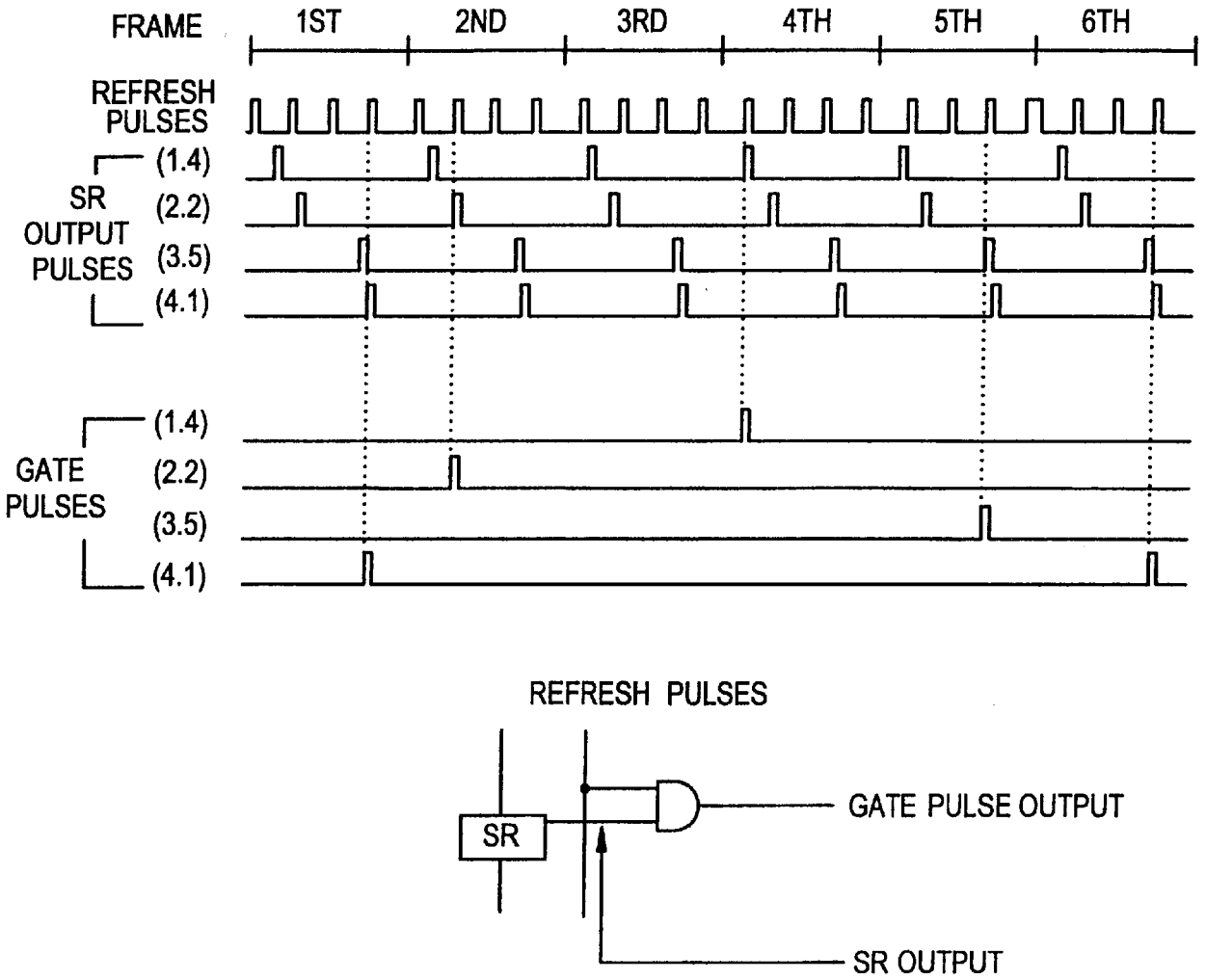
FIG. 14 is a time chart showing how gate pulses are output.

The output pulses (SR outputs) of the gate driver which pulses have been synthesized in the above manner are combined with a refresh pulse in the AND circuit array in a manner shown in FIG. 14. For simplicity, it is assumed that the discussion is directed to a still image and there is no output from the data comparison circuit. Although FIG. 14 shows pulses for only the first group, fourth row (1. 4), the second group, second row (2. 2), the third group, fifth row (3. 5), and the fourth group, first row (4. 1), the same thing applies to the other rows. The shift registers (SRs) for the respective rows regularly output pulses in the first to fifth frames. Only when a refresh pulse coexists with one of the output pulses of the shift registers, it is supplied, as a gate pulse, to the matrix.

For example, in the case of the row (1. 4), the refresh pulse does not coexist with the SR output in any of the first to third frames and the fifth frame and, therefore, the AND circuit does not produce a gate pulse. A gate pulse is produced only in the fourth frame in which the refresh pulse coexists with the SR output. Similarly, a gate pulse is supplied to the row (2. 2) only in the second frame, to the row (3. 5) only in the fifth frame, and to the row (4. 1) only in the first frame.

That is, in this embodiment, a gate pulse is supplied to the ith group, jth row only in the jth frame.

It goes without saying that when there exists an output from the data comparison circuit, a refresh pulse is generated each time and a gate pulse is supplied to the corresponding row.

The invention can reduce power consumption in the active matrix circuit. Further, the invention can suppress a deterioration in the image quality by distributing forcible refresh operations to several frames as described in the first and second embodiments.

It is more effective to combine the invention with various display schemes using an active matrix type device. In active matrix circuits, respective pixels have subtle differences in the display performance due to very small differences in characteristics of individual switching elements. For example, where thin-film transistors (TFTs) are used as the switching elements, a TFT having a large off-current is associated with a large leak current in a non-selected state (supplied with no gate pulse), and is therefore inferior in the charge retaining ability. In a pixel associated with such a TFT, the source should be given a higher voltage than in the ordinary case.

It is desired that the video signal be compensated, in advance, for such characteristics of the switching elements that constitute the active matrix. Such a compensation circuit may be provided after the A/D conversion circuit of the first or second embodiment. This type of compensating operation enables display of images which are clearer and in which defects are less likely to appear. That is, the invention, which performs digital processing, can be combined with other display schemes that require digital processing, to thereby cause a synergetic effect.

The invention can also be combined with a display scheme (for instance, refer to Japanese Patent Unexamined Publication No. Hei. 5-35202) in which gradational display is performed by applying a digital signal, rather than an analog signal, to pixels, to thereby provide further advantages. As such, the invention is useful in the industry concerned.

What is claimed is:

1. An active matrix type device comprising:

a pixel matrix;

a refresh pulse generating circuit;

a data comparison circuit which compares display data of continuous first and second frames in a same pixel of the pixel matrix and which sends a signal to the refresh pulse generating circuit when the display data of the continuous first and second frames in the same pixel are different from each other, the second frame subsequent to the first frame; and a plurality of thin film transistors each provided in a corresponding pixel and connected to a corresponding gate line at a gate electrode thereof, wherein a first refresh pulse is generated in the refresh pulse generating circuit to apply a gate pulse to the gate line of the same pixel when the display data of the continuous first and second frames in the same pixel are different from each other to rewrite the same pixel from the display data of the first frame to the display data of the second frame, wherein the refresh pulse generating circuit divides all of rows of the pixel matrix into N groups each consisting of m rows, wherein a second regular refresh pulse is generated in the refresh pulse generating circuit to apply a scanning signal to a gate electrode of the thin film transistor provided in a k-th row of each group in a k–th frame where k=1, 2, 3, . . . , m, and wherein the k-th row is forcibly rewritten in the k–th frame by the scanning signal.

2. The device of claim 1 wherein the delay circuit comprises a semiconductor memory.

3. The device of claim 1 further comprising an A/D converter for converting an analog video signal to a digital signal.

4. The device of claim 1 further comprising a memory circuit provided upstream of the delay circuit, for changing a temporal order of a digitized video signal.

5. The device of claim 1 wherein a display content is rewritten when the detection circuit detects the difference.

6. The device of claim 1 wherein the active matrix type device is a liquid crystal display.

7. The device of claim 1 wherein the delay circuit comprises a first-in-first-out memory.

8. The device of claim 1 further comprising a refresh pulse generation circuit.

9. An active matrix type device comprising:

a pixel matrix;

a plurality of pixel thin film transistors each provided in a corresponding pixel and connected to a corresponding gate line at a gate electrode thereof;

a refresh pulse generating circuit;

a data comparison circuit which compares display data of continuous first and second frames in a same pixel of the pixel matrix and which sends a signal to the refresh pulse generating circuit when the display data of the continuous first and second frames in the same pixel are different from each other, the second frame subsequent to the first frame;

a gate driver; and an AND circuit provided between the gate driver and the corresponding gate line and having a first input terminal connected with said gate driver for inputting an output signal of the gate driver into the first input terminal, the AND circuit further having a second input terminal connected with the refresh pulse generating circuit, and the AND circuit further having an output terminal connected with the corresponding gate line, wherein a first refresh pulse is generated in the refresh pulse generating circuit to apply a gate pulse to the gate line of the same pixel when the display data of the continuous first and second frames in the same pixel are different from each other to rewrite the same pixel from the display data of the first frame to the display data of the second frame, wherein the refresh pulse generating circuit divides all of rows of the pixel matrix into N groups each consisting of m rows, wherein a second regular refresh pulse is generated in the refresh pulse generating circuit to apply a scanning signal to a gate electrode of the thin film transistor provided in a k-th row of each group in a k-th frame where k=1, 2, 3, . . . ,m, and wherein the k-th row is forcibly rewritten in the k-th frame by the scanning signal.

10. The device of claim 9 wherein the delay circuit comprises a semiconductor memory.

11. The device of claim 9 further comprising an A/D converter for converting and analog video signal to a digital signal.

12. The device of claim 9 further comprising a memory circuit provided upstream of the delay circuit, for changing a temporal order of a digitized video signal.

13. The device of claim 9 wherein the active matrix type device is a liquid crystal display.

14. The device of claim 9 wherein the delay circuit comprises a first-in-first-out memory.

15. An active matrix type device comprising:

a pixel matrix;

a plurality of pixel thin film transistors each provided in a corresponding pixel and connected to a corresponding gate line at a gate electrode thereof;

a refresh pulse generating circuit;

a gate comparison circuit which compares display data of continuous first and second frames in a same pixel of the pixel matrix and which sends a signal to the refresh pulse generating circuit when the display data of the continuous first and second frames in the same pixel are different from each other, the second frame subsequent to the first frame;

a gate driver comprising a third shift register; and an AND circuit provided between the third shift register and the corresponding gate line and having a first input terminal connected with said third shift register for inputting an output signal of the third shift register into the first input terminal, the AND circuit further having a second input terminal connected with the refresh pulse generating circuit, and the AND circuit further having an output terminal connected with the corresponding gate line, wherein a first refresh pulse is generated in the refresh pulse generating circuit to apply a gate pulse to the gate line of the same pixel when the display data of the continuous first and second frames in the same pixel are different from each other to rewrite the same pixel from the display data of the first frame to the display data of the second frame, wherein the refresh pulse generating circuit divides all of rows of the pixel matrix into N groups each consisting of m rows, wherein a second regular refresh pulse is generated in the refresh pulse generating circuit to apply a scanning signal to a gate electrode of the thin film transistor provided in a k-th row of each group in a k-th frame where k=1, 2, 3, . . . , m, and wherein the k-th row is forcibly rewritten in the k-th frame by the scanning signal.

16. The device of claim 15 wherein the delay circuit comprises a semiconductor memory.

17. The device of claim 15 further comprising an A/D converter for converting an analog video signal to a digital signal.

18. The device of claim 15 further comprising a memory circuit provided upstream of the delay circuit, for changing a temporal order of a digitized video signal.

19. The device of claim 15 wherein the active matrix type device is a liquid crystal display.

20. The device of claim 15 wherein the delay circuit comprises a first-in-first-out memory.

21. An active matrix type device comprising:

a pixel matrix;

a plurality of pixel thin film transistors each provided in a corresponding pixel and connected to a corresponding gate line at a gate electrode thereof;

a compensation circuit for compensating a video signal to be applied to a source of the pixel thin film transistor to prevent display performance from differing among the pixels;

a refresh pulse generating circuit; and a data comparison circuit which compares display data of continuous first and second frames in the same pixel of the pixel matrix and which sends a signal to the refresh pulse generating circuit when the display data of the continuous first and second frames in the same pixel are different from each other, the second frame subsequent to the first frame, wherein a first refresh pulse is generated in the refresh pulse generating circuit to apply a gate pulse to the gate line of the same pixel when the display data of the continuous first and second frames in the same pixel are different from each other to rewrite the same pixel from the display data of the first frame to the display data of the second frame, wherein the refresh pulse generating circuit divides all of rows of the pixel matrix into N groups each consisting of m rows, wherein a second regular refresh pulse is generated in the refresh pulse generating circuit to apply a scanning signal to a gate electrode of the thin film transistor provided in a k-th row of each group in a k-th frame where k=1, 2, 3, . . . , m, and wherein the k-th row is forcibly rewritten in the k-th frame by the scanning signal.

22. The device of claim 21 wherein the delay circuit comprises a semiconductor memory.

23. The device of claim 21 further comprising an A/D converter for converting and analog video signal to a digital signal.

24. The device of claim 21 further comprising a memory circuit provided upstream of the delay circuit, for changing a temporal order of a digitized video signal.

25. The device of claim 21 wherein the active matrix type device is a liquid crystal display.

26. The device of claim 21 wherein the delay circuit comprises a first-in-first-out memory.

27. The device of claim 21 further comprising a refresh pulse generation circuit.

* * * * *